United States Patent [19]

Sugizaki et al.

[11] Patent Number: 4,509,661

[45] Date of Patent: Apr. 9, 1985

[54] SQUEEZABLE CONTAINER FOR DISPENSING FOAMED SOL

[75] Inventors: Takashi Sugizaki, Kaizuka; Yoshisuke Sakamoto, Osaka, both of Japan

[73] Assignee: Toyo Seikan Kaisha, Ltd., Tokyo, Japan

[21] Appl. No.: 390,868

[22] Filed: Jun. 22, 1982

[30] Foreign Application Priority Data

Nov. 24, 1981 [JP] Japan ..... 56-186854

[51] Int. Cl.[3] ..... B05B 11/04

[52] U.S. Cl. ..... 222/190; 222/211; 239/327

[58] Field of Search ..... 222/211, 189, 190; 239/327, 343, 370, 575, 590

[56] References Cited

U.S. PATENT DOCUMENTS

| | | | |
|---|---|---|---|
| 3,622,049 | 11/1971 | Thompson | 222/190 |
| 3,973,701 | 8/1976 | Gardner | 222/190 |
| 4,093,124 | 6/1978 | Morane et al. | 222/189 X |
| 4,156,505 | 5/1979 | Bennett | 239/327 |
| 4,286,735 | 9/1981 | Sneider | 222/211 X |

*Primary Examiner*—F. J. Bartuska

*Attorney, Agent, or Firm*—Charles A. Brown; Charles E. Brown

[57] ABSTRACT

A squeezable container for dispensing foamed sol which includes a container body and a nozzle assembly adapted to be connected together by means of threads. The nozzle assembly comprises an internally threaded outer cap member and a double-walled threaded inner cap member for threaded connection together. The double-walled inner cap member includes an outer cylinder having threads on the opposite sides for threaded engagement with the container body and the outer cap member, respectively and an inner cylinder surrounded by the outer cylinder in peripherally spaced relationship thereto to define an air flow passage serving as a check valve for introducing replaceable air into the container body. A pipe joint having an opening, a fluid flow-out pipe and a porous member are coaxially positioned one upon another within the inner cap member inner cylinder whereby the air from the head space in the container body is passed through flow grooves provided in the inner cap member inner cylinder or in the pipe joint into the porous member and the foamable liquid from the container body is passed through the flow-out pipe and the opening in the pipe joint to mix with the air in the porous member. The ratio of the cross-sectional area of the opening in the pipe joint to the sum of the cross-sectional area of the flow-out passages is within the range of 0.2–0.7.

9 Claims, 6 Drawing Figures

SQUEEZABLE CONTAINER FOR DISPENSING FOAMED SOL

FIELD OF THE INVENTION

This invention relates to a suqeezable container for dispensing foamed sol in a desired small amount at one time by squeezing the container at the barrel of the container body and more particularly, to a squeezable container for dispensing foamed sol in which a hollow dome-shaped porous member is positioned in the nozzle assembly of the container, one of foamable liquid and air is passed under pressure from the outside of the porous member through the pores therein into the hollow interior of the member whereas the other of the foamable liquid and air is passed under pressure through a flow-out pipe, a pipe joint having an opening and the open bottom of the porous member into the hollow interior of the porous member to mix with the one fluid in the interior of the porous member to foam the liquid, the foamed liquid is then passed under pressure through the domed top of the porous member to distribute finer foams within the liquid in a high density and thereafter, the foamed liquid having the finer foams distributed therein in the high density is dispensed out of the nozzle assembly in a desired small amount.

THE PRIOR ART

There have been proposed and practically operated a variety of squeezable container for dispensing foamed sol in a desired or required amount each time and in one of the conventional squeezable containers of the type, in order to repeatedly dispense foamed sol in a desired amount, a passage for introducing external replaceable air into the container body when the squeezing pressure applied to the barrel of the body is removed therefrom, a formed sol discharge passage and a passage for feeding the air and foamable liquid within the container body to a mixing chamber to thereby foam the liquid have been provided. That is, the conventional squeezable container has been so designed that when the squeezing pressure applied to the body barrel is removed therefrom, the replaceable air flows through the three passages in the reverse direction. Thus, in the past, in order to mix the two fluids together into a satisfactory foamed sol, each of the passages has to be provided with a constriction, but this constriction has the disadvantage that the constriction obstructs the flow of the replaceable air into the container. And in order to acclerate the introduction of the replaceable air, if the construction is formed having a relatively large cross-sectional area, the constriction of the large cross-sectional area has the disadvantage that the constriction can not provide a satisfactory foamed sol in which fine foams are distributed in a high density.

SUMMARY OF THE INVENTION

Therefore, one purpose of the present invention is to provide a squeezable container adapted to dispense foamed sol in which fine foams are distributed in uniform and high density.

Another object of the present invention is to provide a squeezable container which can be effectively squeezed so as to dispense foamed sol in a satisfactory condition.

Another object of the present invention is to provide a squeezable container which can return to its original condition after a desired amount of foamed sol has been dispensed so that replaceable external air can be rapidly introduced into the body of the container.

Another object of the present invention is to provide a squeezable container which can be operated with the nozzle assembly positioned on top or with the nozzle assembly positioned on bottom.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same in any way.

PREFERRED EMBODIMENTS OF THE INVENTION

Figure 1:
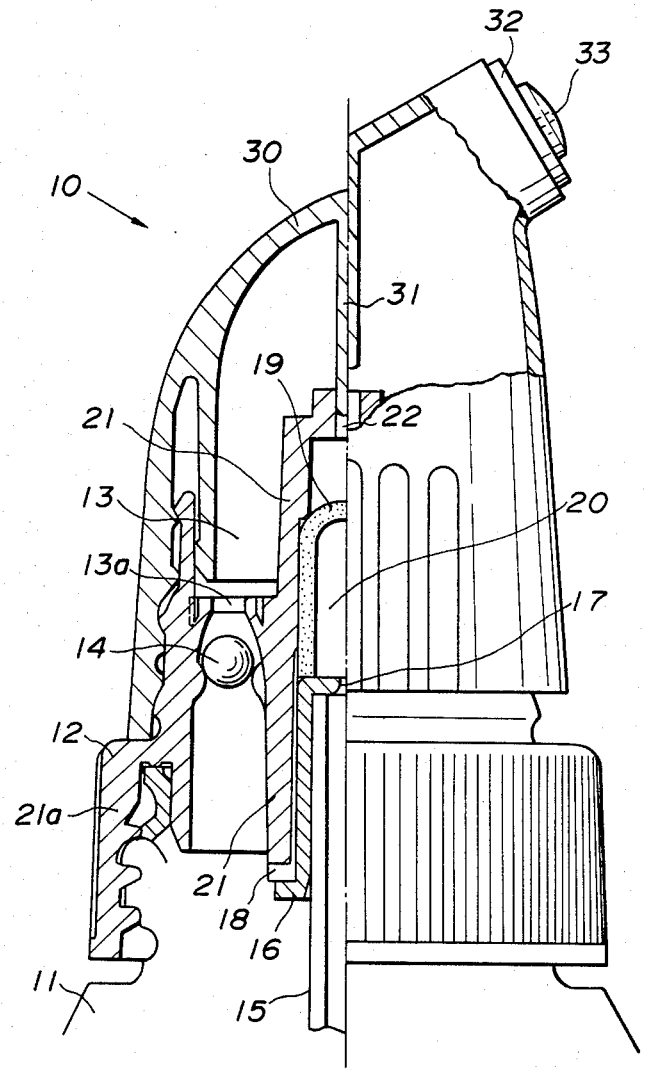
FIG. 1 is an fragmentary elevational view in partial section of a first embodiment of the squeezable container constructed in accordance with the principle of the present invention.
Figure 5:
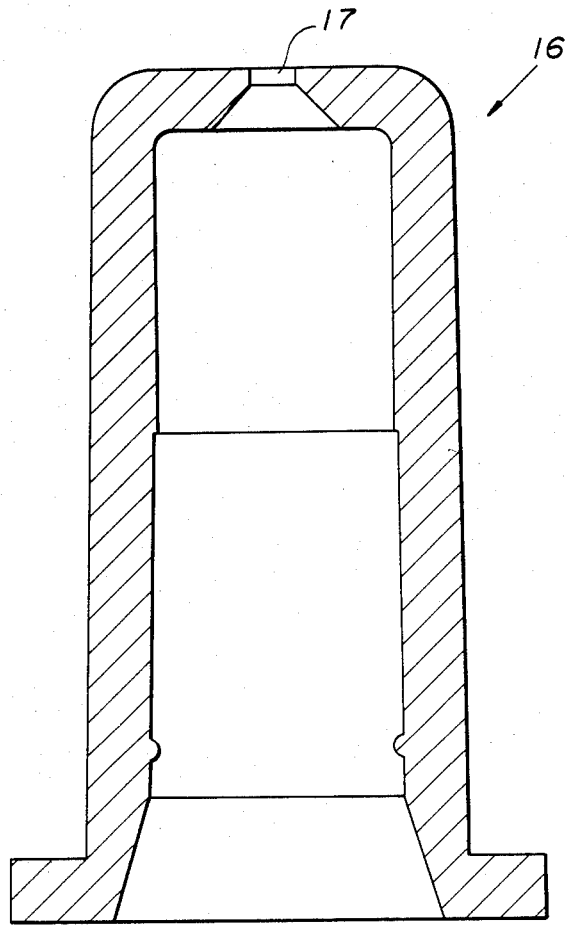
FIG. 5 is a fragmentary vertically sectional view of the pipe joint in the nozzle assembly of said container.

The present invention will be now described referring to the accompanying drawings and more particularly, to FIG. 1 thereof in which the nozzle assembly of the first embodiment of the squeezable container for dispensing foamed sol constructed in accordance with the principle of the present invention is illustrated. The nozzle assembly of the container is generally shown by reference numeral 10 and includes an internally threaded outer cap member 30 and a double walled threaded inner cap member 12 having an inner cylinder 21 and an outer cylinder 21*a* the inner surface of which is provided with threads adapted to engage the externally threaded body 11 of the container. Defined between the inner and outer cylinders 21, 21*a* of the inner cap member 12 is an air inlet passage 13 serving as a check valve 14 is disposed. The passage 13 is formed with a constriction 13*a* which serves as a valve seat. A flanged pipe joint 16 (see FIG. 5) is disposed within the inner cap member inner cylinder 21 with the flange at the bottom thereof positioned below and spaced from the lower end of the inner cylinder 21 for the purpose to be described hereinafter and an air flow-out pipe 15 is positioned within the pipe joint 16 with the lower end of the pipe extending beyond the lower end of the pipe joint 16 (see FIG. 1). The pipe joint and pipe 16, 15 are coaxial with the inner cylinder 21.

The pipe joint 16 is formed at or adjacent the upper end thereof with a communication opening 17 and the inner cylinder 21 of the inner cap member 12 is formed on the inner surface thereof with a suitable number of circumferentially spaced grooves 18 extending from the lower end to a mid point of the inner cylinder 21. An inverted cup-shaped porous member 19 is positioned on the top of the pipe joint 16 coaxial therewith within the inner cylinder 21 so that the liquid from the container body 11 flows through the space defined between the lower end of the inner cylinder 21 and the flange of the pipe joint 16, through the grooves 18 and through the pores in the porous member 19 into the interior 20 of the member 19. The lower end of the porous member 19 is open to communicate with the interior of the flowout pipe 15 through the communication hole 17 in the pipe joint 16 and the closed dome-shaped top of the porous member 19 is adapted to allow foamed liquid to pass therethrough.

An internally threaded outer cap member 30 is in threaded engagement with the reduced diameter externally threaded upper portion of the inner cylinder 21 of the inner cap member 12 and has a solid plug 31 extending downwardly and normally closing the foamed liquid spouting opening 22 formed in the top of the inner cylinder 21 of the inner cap member 12. Fitted in the top of the outer cap member 30 and in communication with the interior of the outer cap member 30 is an adapter 32 for regulating the spouting distance and amount of foamed liquid. As well known in the art, when the outer cap member 30 is unscrewed with respect to the inner cap member 12 as shown in the right-hand half portion of FIG. 1, the plug 31 on the outer cap 30 opens the spouting opening 22 in the top of the inner cap member inner cylinder 21.

With the above-mentioned construction and arrangement of the components of the squeezable container of the present invention, in use, the nozzle assembly 10 is screwed onto the squeezable container body 11.

With the nozzle assembly 10 positioned on top, when the container body 11 is squeezed at the barrel thereof, the air trapped in the head space within the container body 11 pushes the check ball 14 in the check valve or air inlet passage 13 up against the valve seat 13*a* on the check valve 13 to seal the check valve. Thus, upon the squeezing of the container body, the foamable liquid contained in the container body 11 passes through the pipe 15 and the communication opening 17 in the pipe joint 16 into the interior 20 of the porous member 19. On the other hand, the air trapped in the head space in the container body passes through the space defined between the lower end of the inner cap member inner cylinder 21 and the flange of the pipe joint 16, through the grooves 18 in the inner cap member inner cylinder 21 and through the pores in the wall of the porous member 19 into the interior 20 of the porous member 19 whereupon the air mixes with the foamable liquid to cause the liquid to foam and the foamed liquid passes up through the dome-shaped top of the porous member 19 to become a foamed liquid in which finer foams are distributed in a more dense pattern and which passes through the spouting opening 22 in the inner cap member inner cylinder 21 to the adapter 32 from where the foamed liquid discharges itself as a jet through the jet orifice 33 in the adapter 32.

When the external squeezing force applied to the squeezable container body 11 is removed therefrom, the internal pressure within the squeezable container reduces to allow the check ball 14 to drop in the check valve 13 by its own gravity to unseat from the valve seat whereby the air from the atmosphere flows through the adapter orifice 33 and the check valve 13 into the container body 11 which then returns to its original or unsqueezed condition.

When the container is operated with the nozzle assembly 10 positioned on bottom, the check ball 14 seats on the valve seat by both its own gravity and the pressure of the liquid within the container body 11. With the valve seat closed in this manner, when the container body 11 is squeezed, the air in the head space within the container body flows through the pipe 15 and the pipe joint opening 17 into the interior 20 of the porous member 19. On the other hand, the foamable liquid from the container body 11 flows through the space between the lower end of the inner cap member inner cylinder 21 and the bottom flange of the pipe joint 16, through the grooves 18 in the inner surface of the inner cylinder 21 and through the pores in the porous member 19 into the interior 20 of the member 19 whereupon the liquid and air intermix to provide a foamed liquid. Thereafter, as the foamed liquid passes through the pores in the dome-shaped top of the porous member 19, the foams in the liquid reduce their size to provide a foamed liquid having the finer foames distributed in a high density which then spouts through the adapter orifice 33 as a jet. When the squeezing force applied to the container body 11 is removed therefrom, the negative pressure within the container body 11 attracts the check ball 14 away from the valve seat to open the check valve 13 to thereby allow the external air from the atmosphere to flows through the adapter orifice 33 and the check valve 13 into the container body 11 which then returns to its original or unsqueezed condition.

Figure 2:
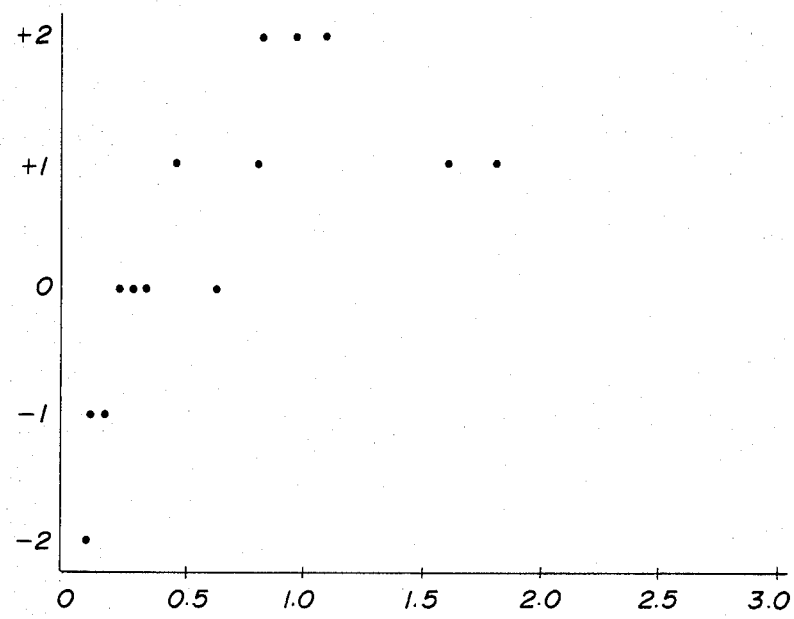
FIG. 2 is a graph wherein the ordinate shows the ratio of the cross-sectional area of the pipe joint opening and the sum of the cross-sectional areas of the flow-out passages in the squeezable container of the invention when the container is operated with the nozzle assembly positioned on top and the abscissa shows the visual observation result of the foamed condition in the spouted foamed sol when the container is operated with the nozzle assembly positioned on top.
Figure 3:
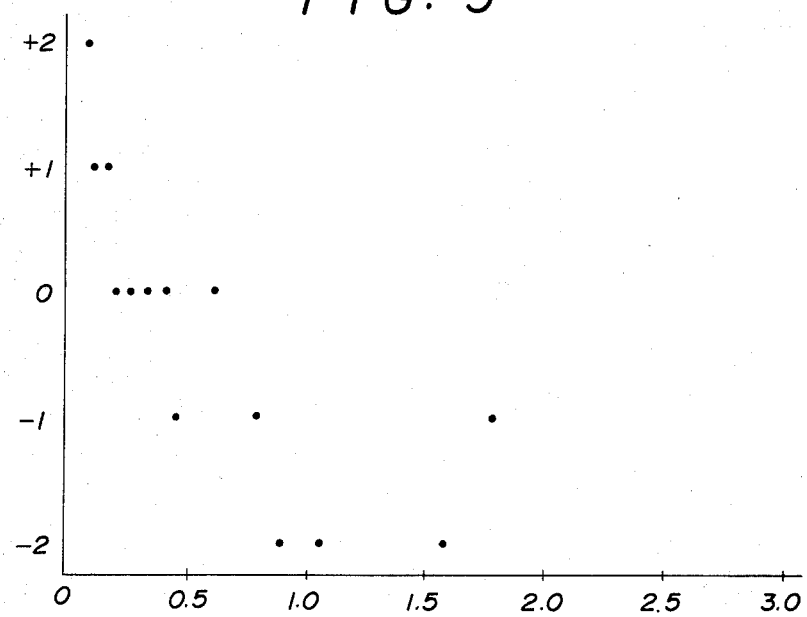
FIG. 3 is a graph wherein the ordinate shows the ratio of the cross-sectional area of the pipe joint opening to the sum of the cross-sectional areas of the flow-out passages in the squeezable container of the invention when the container is operated with the nozzle assembly positioned on bottom and the abscissa shows the visual observation result of the foamed condition in the spouted foamed sol when the container is operated with the nozzle assembly positioned on bottom.

The foamed liquid is spouted through the adapter orifice 33 as a jet in the manner described hereinabove, but in order to spout the foamed liquid in a satisfactory or effective condition, assuming that the cross-sectional area of the communication opening 17 in the pipe joint 16 is $S_2$ and the sum of the cross-sectional areas of the liquid flow grooves 18 is $S_1$, respectively, as shown in the graphs of FIGS. 2 and 3 which show the results of experiments, it has been found that the ratio of $S_2$ to $S_1$ is preferably within the range of 0.2–0.7.

As more clearly shown in FIG. 1, the liquid flow-out grooves 18 extend vertically along the inner surface of the inner cap member inner cylinder 21 in a circumferentially spaced relationship facing the outer surface of the pipe joint 16, but the grooves 18 are not limited to the illustrated arrangement and the grooves 18 may be provided in the outer surface of the pipe joint 16 extending along the length thereof in a circumferentially spaced relationship within the scope of the present invention.

And in order to form fine foams distributed in a high density in the foamable liquid, the size of pores in the porous is one of important factors and the test results shows:

That is, when the average size of the pores in the porous member 19 is less 20μ since the squeezing pressure becomes an undesirably high value which provides unsatisfactory air permeability resulting in insufficient foaming of the foamable liquid. When the average size of the pores in the porous member 19 is within the range of 30–35μ, the liquid foams satisfactorily. However, when the average size of the pores in the porous member 19 is over 40μ, the produced foams are too coarse to provide a satisfactory sol.

In the graphs of FIGS. 2 and 3, the ordinates show the plots of the foam patterns visually observed. Along the ordinate, in the position "0" the foamed liquid and air balance, in the positions "+1" and "+2" the foamed liquid amount is greater than the air amount, respectively and in the positions "−1" and "−2" the air amount is greater than the foamed liquid amount. FIG. 2 is the plot when the container is operated with the nozzle assembly positioned on top whereas FIG. 3 is the plot when the container is operated with the nozzle assembly positioned on bottom. In each of these Figures, along the ordinate, in case of the foam pattern wherein the air amount and the foamed liquid balance or in the position "0", the ratio of the cross-sectional area of the pipe joint communication opening to the sum of the cross-sectional areas of the liquid flow-out passages is within the range of 0.2–0.7. Thus, according to the present invention, in addition to the foam generation passage, the air inlet passage which serves as a check valve is provided and one of the two fluids, that is, the foamed liquid flow and air flow is caused to pass through the flow-out grooves in the inner cap member inner cylinder 21 or the pipe joint 16 holding the flow-out pipe 15 and through the pores in the porous member 19 received in the inner cap member inner cylinder 21 into the interior of the porous member 19. In the nozzle assembly described just above, the ratio of the cross-sectional area of the communication opening in the pipe joint 16 to the sum of the cross-sectional areas of the flow-out grooves 18 is selected within the range of 0.2–0.7.

Figure 4:
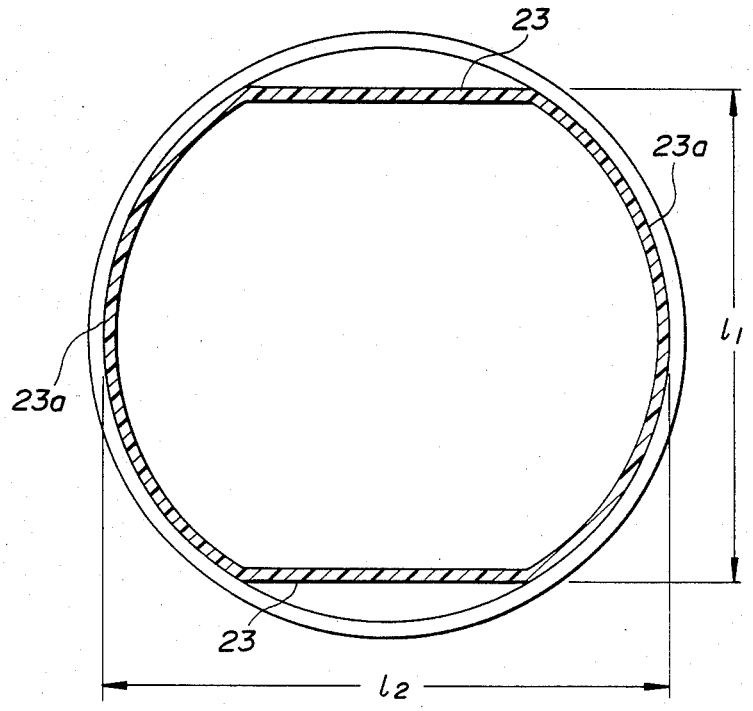
FIG. 4 is a cross-sectional view as seen in a horizontal plane which extends across the barrel of the body of said container.

When the container is operated for foaming the liquid repeatedly, the squeezing pressure applied to the container body and the speed at which the container body returns to its original or unsqueezed condition are important factors. Through the examination of the relationship between the shape of the container body and the speed at which the container body returns to its original condition when the applied squeezing force is removed therefrom, in order to prevent the container body from deforming, it has been found that the cross-section configuration of the barrel of the container body 11 is preferably elliptical defined by a pair of diametrically opposite straight sides 23, 23*a* and a pair of diametrically opposite outwardly convexed sides 23*a*, 23*a* with the distance $l_1$ between the straight sides 23 being shorter than the distance $l_2$ between the convexed sides 23*a* as shorwn in FIG. 4. In the illustrated embodiment, the ratio of $l_2$ to $l_1$ is within the range of 1.12–1.14 to provide satisfactory squeezing pressure and return-to-original-condition speed. Thus, the present invention provides a squeezable container for dispensing foamed liquid in which in addition to a liquid foaming passage, a separate air inlet passage which concurrently serves as a check valve is provided, one of the foamable liquid and air is passed through a flow-out pipe and a communication opening in a pipe joint into a porous member received in an inner cap member inner cylinder and the other of the liquid and air is passed through the flow-out passages provided in the inner cap member inner cylinder or in the pipe joint into the interior of the porous member, characterized by that the cross-section configuration of the barrel of the container body is elliptical defined by a pair of diametrically opposite straight sides and a pair of diametrically opposite outwardly convexed sides and the ratio of the distance $l_2$ between the outwardly convexed sides to the distance $l_1$ between the straight sides is within the range of 1.12–1.14.

Figure 6:
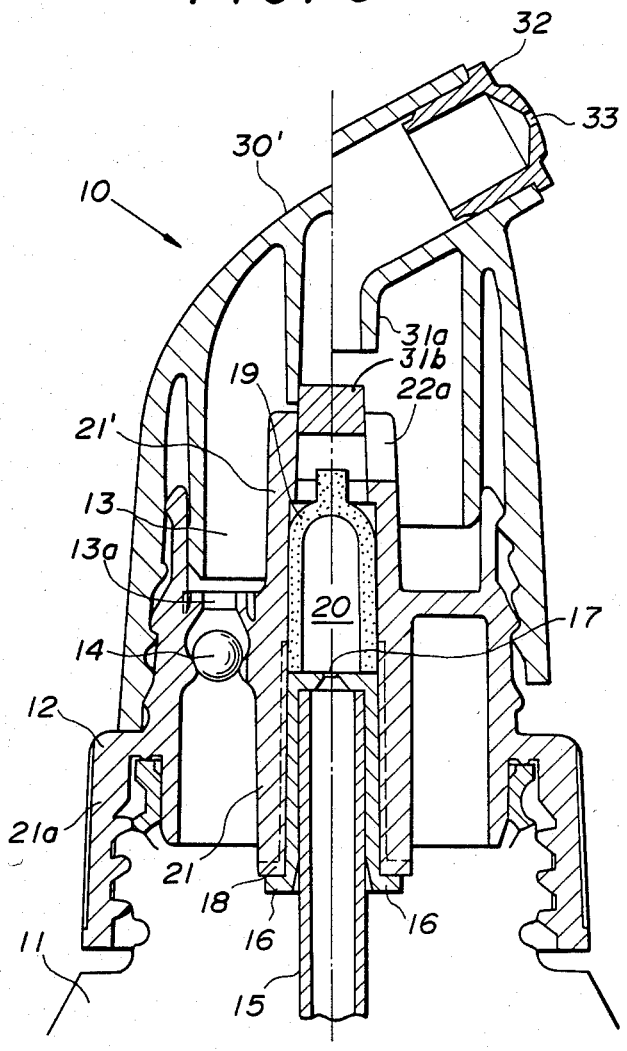
FIG. 6 is a fragmentary vertically sectional view of a second embodiment of the squeezable container constructed in accordance with the principle of the present invention wherein one half portion shows the container in its open position and the other half portion shows the container in its closed position.

Now turning to FIG. 6 which shows the second embodiment of the squeezable container constructed in accordance with the principle of the present invention. The second embodiment is substantially similar to the first embodiment except for the position of the spouting opening in the inner cap member inner cylinder and the construction of the plug on the outer cap member. In the second embodiment, the spouting opening 22*a* is provided on the side of the upper end portion of the inner cap member inner cylinder 21' and the plug 31*a* depending from the outer cap member 30' is hollow for communicating the adapter orifice 33 with the spouting opening 22*a*. In order to close the adapter orifice 33 relative to the spouting opening 22*a* and the interior of the outer cap 30, the inner cylinder 21' has projecting therefrom a projection 31*b* which enters and closes the open end of the plug 31*a* when the outer cap 30' is in its retracted position. The rest of the second embodiment is the same as the first embodiment and thus, further description on the second embodiment will be omitted herein.

While particular embodiments of the invention have been shown and described, various modifications will be apparent to those skilled in the art and therefore it is not intended that the invention be limited to the disclosed embodiments or to details thereof, and departures may be made therefrom within the spirit and scope of the invention.

What is claimed is:

1. A squeezable container for dispensing foamed sol which comprises a container body and a nozzle assembly adapted to be connected together by means of threads, said nozzle assembly comprising an internally threaded outer cap member having a plug and a double walled inner cap member including a threaded outer cylinder for threaded engagement with said container body and said outer cap member, respectively and an inner cylinder surrounded by said outer cylinder in peripherally spaced relationship thereto to define a check valve therebetween, said inner cylinder including a spouting opening to be closed and opened by said plug, an inverted U-shaped flanged pipe joint received in said inner cylinder of the inner cap member and having a communication opening at the top, the flange at the lower end of said pipe joint being positioned below and spaced from the lower end of said inner cylinder of the inner cap member, a flow-out pipe received in said pipe joint and opens at the top and bottom for communication with said communication opening and the interior of said container body, respectively, an inverted cup-shaped porous member positioned on the top of said pipe joint in said inner cylinder of the inner cap member, flow-out passage means extending from the space between said lower end of the inner cylinder and said bottom flange of the pipe joint to a point of the outer surface of said porous member, and an adapter adjustably fitted in the leading end of said outer cap member.

2. The squeezable container for dispensing foamed liquid as set forth in claim 1, in which said flow-out passage means comprises a plurality of circumferentially spaced grooves extending along the outer surface of said pipe joint.

3. The squeezable container for dispensing foamed liquid as set forth in claim 1, in which said flow-out passage means comprises a plurality of circumferentially spaced grooves extending along the inner surface of said inner cylinder of the inner cap member.

4. A device for dispensing foamed sol which comprises a squeezable container body and a nozzle assembly, said nozzle assembly including:

(A) an outer cap member having, (a) an adaptor with an orifice for dispensing foamed sol therefrom, (b) an air passage infeeding air from said orifice to the interior of the container body, (c) a set of engaging means, and (d) plug means for blocking dispensation of foamed sol; and (B) an inner cap member having, (a) an inner cylinder in which a porous member having an inverted cup shape and a pipe joint having a communication opening and supporting a flow-out pipe therein, with an end of said flow-out pipe extending to and being received by the container body, (b) an opening connecting the interior of the container body to said orifice through said porous member when said plug means is moved upwardly to an open position, and being closed when said plug means is moved downwardly by rotating said outer cap member against said inner cap member respectively, (c) flow-out grooves connecting the interior of the container body to said porous member, (d) check valve means allowing the air flow only from said air passage to the container body, and (e) two sets of inner cap member engaging means, one of said inner cap member engaging means being connected to the container body and the other of said inner cap member engaging means being integral with said engaging means of said outer cap member, wherein, by squeezing the container body having the contents of foamable liquid and air contained therein one of the contents is passed, under pressure, through said flow-out pipe and said communication opening having a cross-sectional area and of said pipe joint into the interior of said porous member, and the other of the contents is passed under pressure through said flow-out grooves, from the outside of said porous member through the pores therein, into the interior of said porous member, in order to pre-mix each other therein, said flow-out pipe, pipe joint and porous member being positioned one upon another in coaxial relation with each other within said inner cylinder, and the ratio of the cross-sectional area of said communication opening of said pipe joint being directly connected to the interior portion of said porous member to the sum of the cross-sectional areas of said flow-out grooves being connected thereto through the pores of said porous member itself is within the range of 0.2–0.7.

5. The device for dispensing foamed sol claimed in claim 4, wherein the container body has a barrel with a cross-section configuration which is elliptical and defined by a pair of diametrically opposite outwardly convexed sides and a pair of diametrically opposite straight sides with the ratio of the distance between the convexed sides to the distance between the straight sides is within the range of 1.12–1.14.

6. The device for dispensing foamed sol as set forth in claim 4 in which said flow-out grooves comprise a plurality of circumferentially spaced grooves extending along the outer surface of said pipe joint.

7. The device for dispensing foamed sol as set forth in claim 4 in which said flow-out grooves comprise a plurality of circumferentially spaced grooves extending along the inner surface of said inner cylinder of the inner cap member.

8. The device for dispensing foamed sol as set forth in claim 5 in which said flow-out grooves comprise a plurality of circumferentially spaced grooves extending along the outer surface of said pipe joint.

9. The device for dispensing foamed sol as set forth in claim 5 in which said flow-out grooves comprise a plurality of circumferentially spaced grooves extending along the inner surface of said inner cylinder of the inner cap member.

* * * * *